US008110995B2

(12) United States Patent
Deurenberg

(10) Patent No.: US 8,110,995 B2
(45) Date of Patent: Feb. 7, 2012

(54) ILLUMINATION SYSTEM COMPRISING A PLURALITY OF LIGHT SOURCES

(75) Inventor: Peter Hubertus Franciscus Deurenberg, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 462 days.

(21) Appl. No.: 12/302,509

(22) PCT Filed: Jun. 6, 2007

(86) PCT No.: PCT/IB2007/052123

§ 371 (c)(1),
(2), (4) Date: Nov. 26, 2008

(87) PCT Pub. No.: WO2007/148250

PCT Pub. Date: Dec. 27, 2007

(65) Prior Publication Data

US 2009/0236994 A1 Sep. 24, 2009

(30) Foreign Application Priority Data

Jun. 20, 2006 (EP) ..... 06115739

(51) Int. Cl.
*H05B 37/02* (2006.01)

(52) U.S. Cl. ..... 315/152; 315/149; 315/159; 315/169.3; 315/291; 315/312

(58) Field of Classification Search ..... 315/118, 315/149, 159, 169.3, 224, 291, 307, 308, 315/312; 362/227, 800; 250/205
See application file for complete search history.

(56) References Cited

U.S. PATENT DOCUMENTS 6,411,046 B1 * 6/2002 Muthu ..... 315/309
6,441,558 B1 * 8/2002 Muthu et al. ..... 315/149

(Continued)

FOREIGN PATENT DOCUMENTS

EP 1346609 B1 8/2005

(Continued)

OTHER PUBLICATIONS

Frank J. P. Schuurmans et al: "Red, Green, and Blue LEDs for White Light Illumination", IEEE Journal on Selected Topics in Quantum Electronics, IEEE Service Center, Piscataway, NJ, US, vol. 8, No. 2 Mar. 2002, pp. 333-338, XP011066115.

(Continued)

*Primary Examiner* — Douglas W Owens
*Assistant Examiner* — Thai Pham
(74) *Attorney, Agent, or Firm* — Mark L. Beloborodov

(57) ABSTRACT

An illumination system (1) comprises a plurality of light sources (11, 12, 13), each provided with a driver (21, 22, 23); a controller (30) for generating control signals ($S_{c1}$, $S_{c2}$>$S_{c3}$) for controlling the respective drivers; temperature feed forward means (60, 61, 62, 63, 81) for establishing a temperature feed forward (TFF) correction mechanism; flux feedback means (71, 82, 83, 84) for establishing a flux feedback (FFB) correction mechanism. The controller is capable of operating in a first mode of operation wherein both the temperature feed forward correction mechanism and the flux feedback correction mechanism are active, and is capable of operating in a second mode of operation wherein the temperature feed forward correction mechanism is active and the flux feedback correction mechanism is inactive. The controller is designed to monitor the duty cycles of the control signals and to select its mode of operation based on said duty cycles.

5 Claims, 4 Drawing Sheets

U.S. PATENT DOCUMENTS

| | | | | |
|---|---|---|---|---|
| 6,630,801 | B2 * | 10/2003 | Schuurmans | 315/307 |
| 6,731,083 | B2 * | 5/2004 | Marcinkiewicz | 318/254.2 |
| 2004/0021859 | A1 | 2/2004 | Cunningham | |
| 2007/0040512 | A1 * | 2/2007 | Jungwirth et al. | 315/159 |
| 2007/0273290 | A1 * | 11/2007 | Ashdown et al. | 315/113 |
| 2008/0272702 | A1 * | 11/2008 | Van Erp et al. | 315/151 |
| 2008/0297066 | A1 * | 12/2008 | Meijer et al. | 315/291 |

FOREIGN PATENT DOCUMENTS

| | | | |
|---|---|---|---|
| WO | 0247438 | A2 | 6/2002 |

OTHER PUBLICATIONS

P.Deurenberg et al; "Achieving Color Point Stability in RGB Multi-Cip LED Modules Using Various Color Control Loops", Proceedings of the SPIE, SPIE, Bellingham, VA, US, vol. 5941, Sep. 7, 2005, pp. 1-12, XP002428542.

Subramaninan Muthu et al; "Red, Green and Blue LED-Based White Light Source: Imlementation Challenges and Control Design", Conf. Record of the IEEE Industry Applications 2003.

* cited by examiner

ILLUMINATION SYSTEM COMPRISING A PLURALITY OF LIGHT SOURCES

This application is a national stage application under 35 U.S.C. §371 of International Application No. PCT/IB2007/052123 filed on Jun. 6, 2007, and published in the English language on Dec. 27, 2007, as International Publication No. WO/2007/148250, which claims priority to European Application No. 06115739.2, filed on Jun. 20, 2006, incorporated herein by reference.

FIELD OF THE INVENTION

The present invention relates in general to the field of color illumination. More particularly, the present invention relates to an illumination device comprising a plurality of light sources, of which the color and the luminance level is controllable. In the following explanation, it will be assumed that each light source is implemented as a LED, but the present invention can also be practiced with other types of light sources, for instance TL lamps, halogen lamps, etc.

BACKGROUND OF THE INVENTION

Generally speaking, there is a desire for illumination devices that are capable of generating light with a variable light intensity (dimming) and variable color. As should be clear to a person skilled in the art and therefore needs no elaborate explanation, it is possible to generate light of all possible colors in a large portion of the color gamut with a system that comprises three LEDs generating light of mutually different colors. In a typical example, one LED generates RED light, a second LED generates GREEN light, and a third LED generates BLUE light. The combined light output of these three LEDs has a mixed color within the color triangle defined by the colors of these three LEDs, and the exact color point within this color triangle depends on the mutual ratios of the intensities of the three LEDs. Thus, varying the color point of the system can be done by changing the relative intensity of one of the three LEDs, whereas varying the intensity of the light output while maintaining the color point can be done by changing the intensities of all LEDs to the same extent.

It is noted that it is possible to use more than three LEDs with mutually different colors; in such case, the present invention can also be applied, with suitable adaptations, as will become clear to a person skilled in the art.

For controlling the intensities of the respective LEDs, the system comprises a controller, typically implemented as a microcontroller. The microcontroller has an input for receiving a set signal, for instance from a central microcontroller or PC. The microcontroller further has three control outputs, one for each LED, for controlling the operation of the respective LEDs. Typically, the LEDs are operated with a variable duty cycle to achieve variation of the respective light intensities. The control output signals from the microcontroller to the respective LEDs are generated on the basis of the received input set signal, and on the basis of formulas or tables stored in a memory and defining a one-to-one relationship between input set signal and set points of the respective LEDs.

A problem in this respect is the fact that, even when controlled by a constant control signal, the intensities and color (wavelength) of the LEDs may vary, for instance under the influence of changing temperature, or for instance as a result of ageing. A further aspect of the problem is that the individual LEDs are not necessarily affected to the same extent, so there is differential variation. As a consequence, the color point of the system may vary with temperature and time. In order to prevent such color point variation, the controller should be provided with some compensation mechanism.

Such compensation mechanisms for the controller are known per se. A first compensation mechanism is called "temperature feed forward", for short TFF. The system is provided with temperature detecting means detecting the temperature of the LEDs, specifically the junction temperatures of the individual LEDs. The said memory contains formulas or tables for correcting the said one-to-one relationship on the basis of the measured temperature. In a possible embodiment, the said memory comprises a matrix of LED control tables as a function of temperature, and the controller uses the "correct" table corresponding to the current temperature. It is also possible that the said memory comprises a matrix of correction factors as a function of temperature, and the controller reads the control signals from the table on the basis of user setting and applies the correction factors on the basis of the current temperature. An advantage of this compensation mechanism is that it is relatively fast, but a drawback is that it relies on predetermined data and does not take into account possible deviations from the predetermined data. Further, a drawback is that this compensation mechanism can not compensate for variations caused by ageing.

A second compensation mechanism is based on feedback of the light output ("flux feedback", for short FFB). The system is provided with an optical sensor for sensing the actual light output (flux) of the individual LEDs, and the controller adapts its drive signals such that the actual light output of the LEDs is equal to the intended light output. An advantage of this compensation mechanism is that it does not need to have data regarding temperature response determined in advance, and that it always takes into account the actual light output situation. However, a drawback of this compensation mechanism is that it requires three optical sensors, one per LED, thus adding to the hardware costs. To reduce this hardware problem, a variation of this compensation mechanism is known, where the system comprises only one common optical sensor for sensing the overall light of the combined light output of the LEDs. This mechanism further requires a specific timing of the individual LEDs, to assure that it is possible to obtain measuring signals from which the individual light outputs can be derived, for instance by assuring that there are time intervals when only one of the LEDs is ON while all others are OFF. Now a disadvantage is that the flux measurement requires a minimum amount of time. This puts a restriction on the lower limit of the duty cycle that can be set for the LEDs, thus a limitation of the color points that can be set and a limitation of the dimming range.

It is noted that European patent 1.346.609 discloses a system where a controller comprises a TFF part and an FFB part operating in series, wherein the TFF part and the FFB part are active simultaneously. Although in such system the TFF part can compensate some of the disadvantages of the FFB part, the restriction on the lower limit of the duty cycle that can be set for the LEDs remains a problem caused by the FFB part.

It is an important objective of the present invention to overcome the above disadvantages.

SUMMARY OF THE INVENTION

According to an important aspect of the present invention, the controller is capable of operating in two operating modes. In a first operating mode, control is performed on the basis of both TFF and FFB. In a second operating mode, control is performed on the basis of TFF alone, the FFB facility being ignored. Switching between the first operating mode and the second operating mode is done on the basis of the duty cycles: if the controller finds that at least one of the duty cycles of the LEDs corresponds to a duration of the ON interval shorter than a minimum time required for performing the flux measurements, the controller selects the second operating mode, otherwise (normal situation) the controller selects the first operating mode.

BRIEF DESCRIPTION OF THE DRAWINGS

These and other aspects, features and advantages of the present invention will be further explained by the following description with reference to the drawings, in which same reference numerals indicate same or similar parts, and in which.

DETAILED DESCRIPTION OF THE INVENTION

Figure 1:
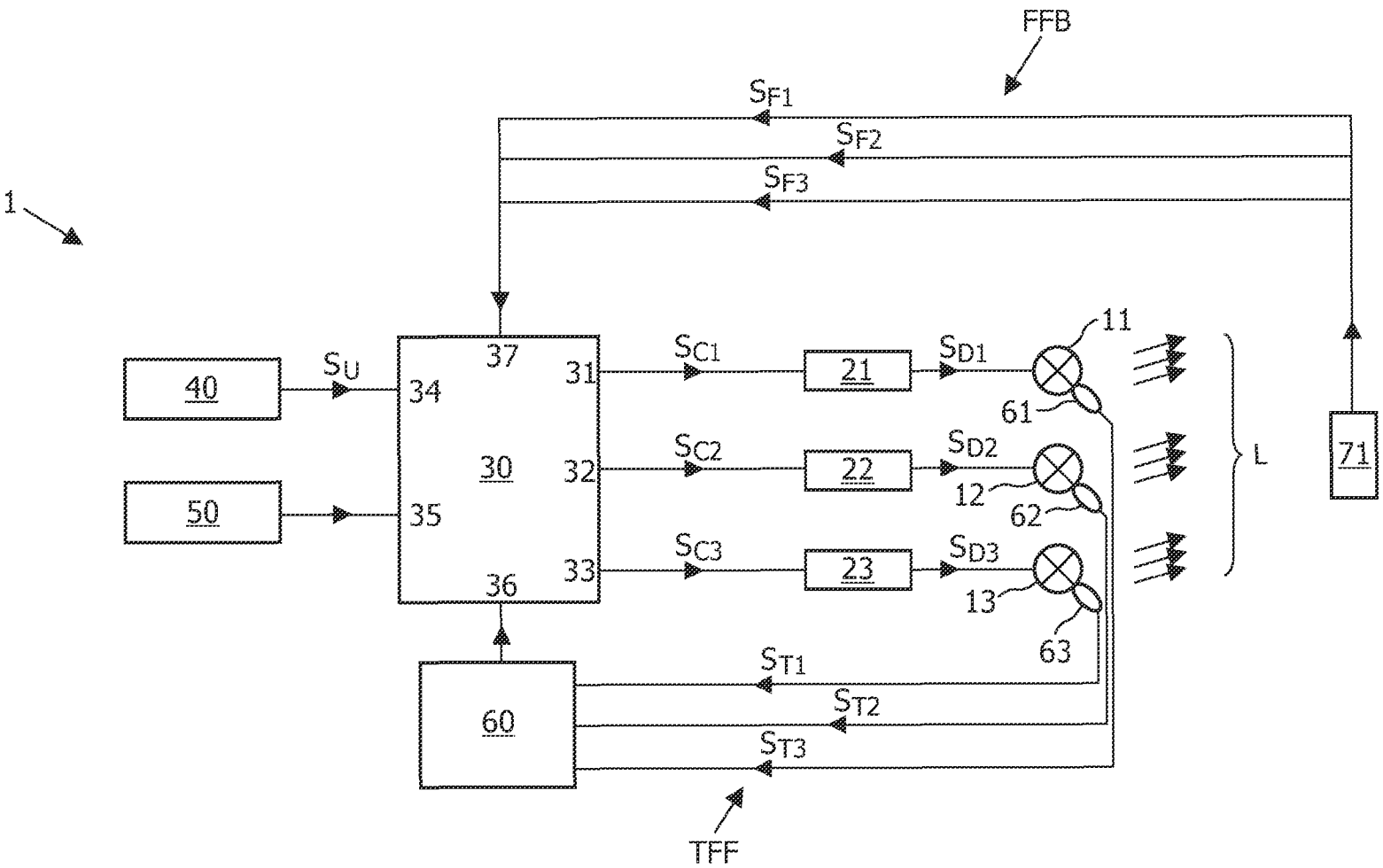
FIG. 1 shows a schematic block diagram of an illumination system according to the present invention.

FIG. 1 schematically shows a block diagram of an illumination system 1, comprising an arrangement of three light sources 11, 12, 13 for generating light of mutually different colors. Typically, those colors are red (R), green (G) and blue (B), but other colors are also possible. The light output of the system 1 as a whole is indicated at L, which is a combination (mixture) of the individual light outputs R, G and B. This light mixture has a color point within the color triangle defined by the individual colors R, G and B, as should be clear to a person skilled in the art. The light sources are advantageously implemented as LEDs, but other types of light sources, such as for instance TL lamps, halogen lamps, etc are also possible. It is noted that a light source may actually comprise two or more LEDs of substantially identical color arranged in parallel or in series, but in the following it will be assumed that each light source comprises exactly one LED.

The system 1 further comprises drivers 21, 22, 23 associated with the respective LEDs, for driving the LEDs with appropriate LED drive signals $S_{D1}$, $S_{D2}$, $S_{D3}$, typically direct current signals. Since LED drivers are known per se while the design of the drivers is no subject of the present invention, a more elaborate description of the design and operation of the drivers is not needed here. It suffices to say that the drivers are responsive to control signals $S_{C1}$, $S_{C2}$, $S_{C3}$, received at their respective control inputs, for switching the LEDs ON and OFF repeatedly. The time interval during which a LED is ON will be indicated as ON interval with duration $t_{ON}$. The time interval during which a LED is OFF will be indicated as OFF interval with duration $t_{OFF}$. The total period of switching has a duration $t_{PERIOD}$ equal to $t_{ON}+t_{OFF}$. A duty cycle Δ is defined as $\Delta=t_{ON}/t_{PERIOD}$. The three LEDs may have mutually different switching periods, but usually the switching periods are equal for all LEDs. Each LED is designed for operation with a nominal current magnitude. LED drivers are typically designed to have the current magnitude during the ON interval be equal to the nominal current magnitude. Each LED has a nominal light output that is achieved when the LED is operated with duty cycle Δ=100% at the nominal current magnitude. It should be clear to a person skilled in the art that varying the duty cycle of a LED results in a corresponding variation of the light output of that LED, and that varying the light output of the three LEDs results in a variation of the color of the output light mixture L and/or a variation of the brightness of the output light mixture L.

The system 1 further comprises a controller 30 having three outputs 31, 32, 33 coupled to control inputs of the respective drivers 21, 22, 23. The controller 30 is designed to generate control signals $S_{C1}$, $S_{C2}$, $S_{C3}$ for the respective drivers 21, 22, 23, instructing the drivers to set certain duty cycles for the respective LEDs 11, 12, 13. Typically, a control signal $S_{C1}$, $S_{C2}$, $S_{C3}$ is a digital signal that has a value 1 during the ON interval and a value 0 during the OFF interval, so that the control signal not only determines the value of the duty cycle Δ but also determines the precise timing of the ON and OFF intervals.

The controller 30 has a user control input 34 for receiving a user input signal $S_U$ from a user input device 40. Such user input device 40 may for instance be a keyboard, or any other suitable type of device with which a user can enter his choice of a certain color point and brightness. Based on the user input signal $S_U$, the controller 30 generates the control signals $S_{C1}$, $S_{C2}$, $S_{C3}$ at its outputs 31, 32, 33. The controller 30 determines which control signals $S_{C1}$, $S_{C2}$, $S_{C3}$ to generate on the basis of information stored in an associated memory 50 coupled to a memory input 35 of the controller 30; alternatively, the memory may be part of the controller itself. The memory contains information determining the relationship between control signals (or duty cycles) on the one hand and color points and brightness on the other hand. This information may be available in the form of a lookup table, a formula, etc.

A problem is that the light output of a LED does not depend on the duty cycle alone: caused by factors such as temperature and ageing, deviations may occur in color, in flux, or both. To compensate for such deviations, the system 1 is provided with two correction mechanisms. A first correction mechanism TFF is based on measuring the junction temperature of the LEDs. Although the system may comprise one common temperature sensor, FIG. 1 illustrates that each LED 11, 12, 13 is provided with a respective temperature sensor 61, 62, 63, providing temperature measurement signals $S_{T1}$, $S_{T2}$, $S_{T3}$, respectively. Since methods for measuring the junction temperature of a LED are known per se and can be applied in the present invention, while the present invention does not relate to improving temperature measurement methods, it is not necessary to explain the design and operation of a temperature sensor in great detail here.

The influence of the temperature is known in advance, for instance from experiments. The controller 30 is provided with a temperature correction memory 60, coupled to a temperature correction input 36, which memory 60 contains information, for instance in the form of a matrix, a lookup table, a formula, or the like, informing the controller 30 how to amend its control signals $S_{C1}$, $S_{C2}$, $S_{C3}$ as a function of temperature. It is noted that the temperature correction memory 60 may be combined with the memory 50.

A second correction mechanism FFB is based on measuring the actual light intensity (flux) of the individual LEDs. Although the system may comprise individual flux detectors, FIG. 1 illustrates that the system comprises one common flux detector 71 detecting the intensity of the mixed light L. Since detectors for measuring the light flux are known per se and can be applied in the present invention, while the present invention does not relate to improving light detectors, it is not necessary to explain the design and operation of a light detector in great detail here.

Figure 2:
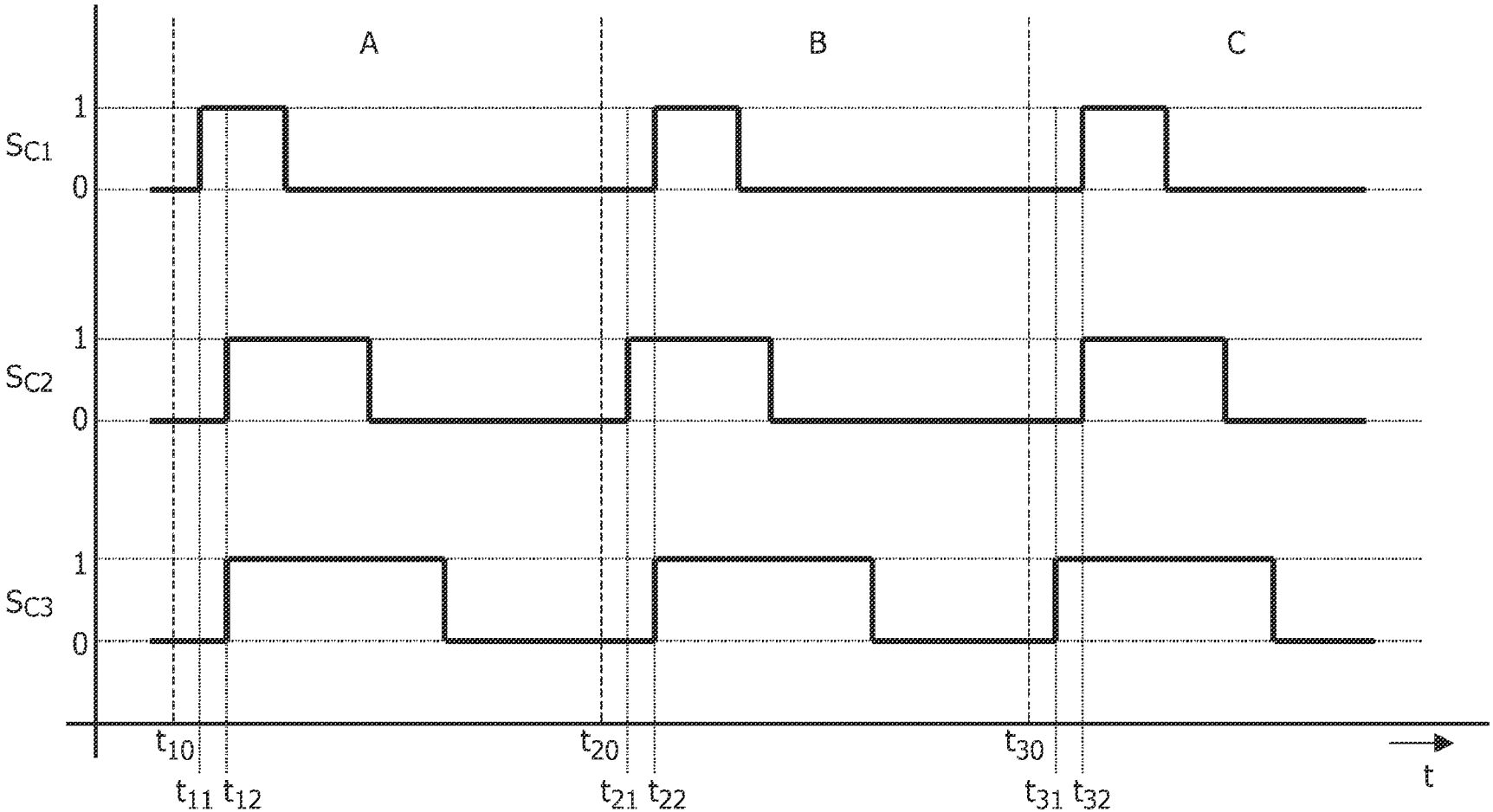
FIG. 2 is a timing diagram illustrating a possible mode of timing for the control signals to respective lamps.

FIG. 2 is a timing diagram illustrating that it is possible to measure the light intensity of each individual LED using one common flux detector 71. In a first period A, the timing of the ON interval of the first LED 11 is advanced with respect to the timing of the second and third LEDs; the controller, who determines this timing, knows that the output signal from the flux detector 71 during the measurement interval from $t_{11}$ to $t_{12}$ represents the light intensity of the first LED 11 only. In a second period B, the timing of the ON interval of the second LED 12 is advanced with respect to the timing of the first and third LEDs, so that the output signal from the flux detector 71 during the measurement interval from $t_{21}$ to $t_{22}$ represents the light intensity of the second LED 12 only. In a third period C, the timing of the ON interval of the third LED 13 is advanced with respect to the timing of the first and second LEDs, allowing the controller to measure the light intensity of the third LED 13 only in the measurement interval from $t_{31}$ to $t_{32}$. In FIG. 1, flux measurement signals representing the individual fluxes of the individual LEDs are indicated as $S_{F1}$, $S_{F2}$, $S_{F3}$, respectively.

The controller 30 receives the flux measurement signals $S_{F1}$, $S_{F2}$, $S_{F3}$ at a flux measurement input 37. Based on the user input signal $S_U$, the information from the memory 50, and the information from the temperature correction memory 60, the controller 30 knows what the flux should be for each LED; this will be indicated as "target flux". If the actual flux deviates from the target flux, the controller 30 amends its control signals such as to reduce the deviation.

Figure 3:
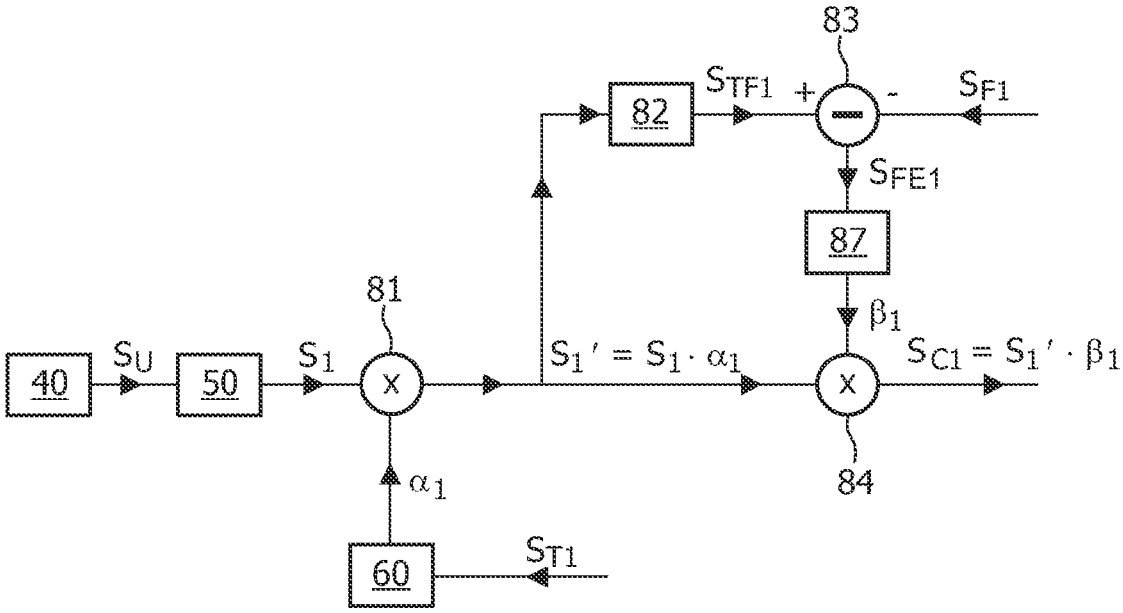
FIG. 3 is a block diagram schematically illustrating a first mode of operation of the illumination system.

This mode of operation is illustrated in more detail in FIG. 3. On the basis of the user input signal $S_U$, a first approximation value $S_1$ for the first control signal is taken from memory 50. Based on the temperature measurements, a first correction value $\alpha_1$ is taken from the temperature correction memory 60, and a second approximation value $S_1'$ for the first control signal is calculated by multiplying the first approximation value $S_1$ and the first correction value $\alpha_1$, as illustrated by a multiplier 81. This first correction value $\alpha 1$ compensates deviations in color and flux of the LEDs as anticipated on the basis of temperature.

Further, from this second approximation value $S_1'$, a target value $S_{TF1}$ for the flux of the first LED 11 is derived by a flux calculator 82.

In a subtractor 83, the first flux measurement signal $S_{F1}$ is subtracted from the first target value $S_{TF1}$, resulting in a first flux error signal $S_{FE1}$. The first flux error signal $S_{FE1}$ may be multiplied by a suitable gain, but this is not illustrated. In a PID block 87, the first flux error signal $S_{FE1}$ is translated to a second correction value $\beta 1$. In a second multiplier 84, the second approximation value $S_1'$ is multiplied by the second correction value $\beta_1$ to give the first control signal $S_{C1}=S_1 \cdot \alpha_1 \cdot \beta_1$.

It is noted that FIG. 3 only shows the operation for the first control signal $S_{C1}$. The operation for the second and third control signals $S_{C2}$ and $S_{C3}$ is similar, as should be clear to a person skilled in the art, and is therefore not shown for sake of simplicity.

Figure 4:
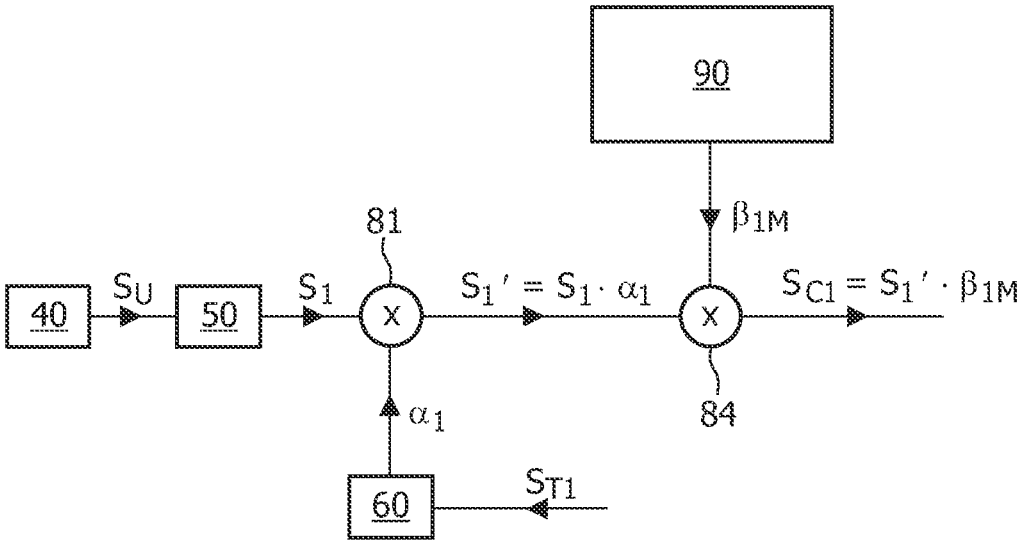
FIG. 4 is a block diagram schematically illustrating a second mode of operation of the illumination system.

According to an important aspect of the present invention, the controller 30 monitors the duty cycle of the control signals $S_{C1}$, $S_{C2}$, $S_{C3}$. If at least one duty cycle is lower than a predetermined level, the controller 30 switches to a second mode of operation. For instance, in a practical embodiment, the period of the control signals has a duration $t_{PERIOD}$ of 8 ms, while the flux measurement takes 360 μs. Then, the duration $t_{ON}$ of the ON interval must at least be equal to 360 μs, i.e. the duty cycle Δ must at least be equal to 4.5%. The second mode of operation is illustrated in FIG. 4. FIG. 2 also shows a "dead" interval from the start $t_{10}$ of a period till the start $t_{11}$ of the first ON interval, during which all LEDs are OFF, allowing the controller 30 to perform a zero-measurement.

When the controller 30 finds that at least one duty cycle is lower than the required minimum level, the controller 30 stores the current values of the second correction values $\beta_1$, $\beta_2$, $\beta_3$ into a flux correction memory 90. During further operation, the controller 30 will take the stored correction values, now indicated as "memorized" correction values $\beta_{1M}$, $\beta_{2M}$, $\beta_{3M}$, respectively, from this memory 90. These are, of course, constant in time. Thus, the compensation mechanism is based on TFF only, and the flux-based compensation action is constant in time, "frozen" to the situation at the moment when the lowest duty cycle became lower than the predetermined minimum. The actual flux measurements are ignored in this second mode of operation. In fact, since flux measurements are not needed, the "dead" interval ($t_{10}$ to $t_{11}$) is not needed any more in this second mode. The LEDs can be dimmed to lower values, only determined by the resolution of the controller.

It is noted that the error caused by ignoring the actual flux measurements are expected to be relatively low. Possible flux deviations caused by temperature changes are compensated by temperature correction memory 60 on the basis of the actual measured temperature. Possible flux deviations caused by ageing are compensated by comparator 83 and multiplier 84, but these effects are unlikely to change rapidly with time, so for relatively brief periods these deviations may be considered constant and their required compensation may be considered constant, so memory 90 offers adequate compensation.

During this second mode of operation, the controller 30 continues to monitor the duty cycle of the control signals $S_{C1}$, $S_{C2}$, $S_{C3}$. If all duty cycles are above the required minimum level, the controller 30 switches to the first mode of operation of FIG. 3, wherein the flux error signals $S_{FE1}$, $S_{FE2}$, $S_{FE3}$ are obtained from subtractor 83 instead of from memory 90.

It should be clear to a person skilled in the art that the present invention is not limited to the exemplary embodiments discussed above, but that several variations and modifications are possible within the protective scope of the invention as defined in the appending claims.

For instance, in the above exemplary description, the second correction values $\beta_1$, $\beta_2$, $\beta_3$ are stored in memory 90 and read from memory 90, but it is also possible that, at the moment of switching from first mode to second mode, the momentary values of the flux measurement signals $S_{F1}$, $S_{F2}$, $S_{F3}$ are stored in a memory and that the target values $S_{TF1}$, $S_{TF2}$, $S_{TF3}$ are compared with the "frozen" values of the flux measurement signals $S_{F1}$, $S_{F2}$, $S_{F3}$ from memory 90.

Further, in FIG. 4, the output of the memory 90 is coupled to the same multiplier 84 as the output of subtractor 83. However, it is also possible to use a different multiplier.

Figure 5A:
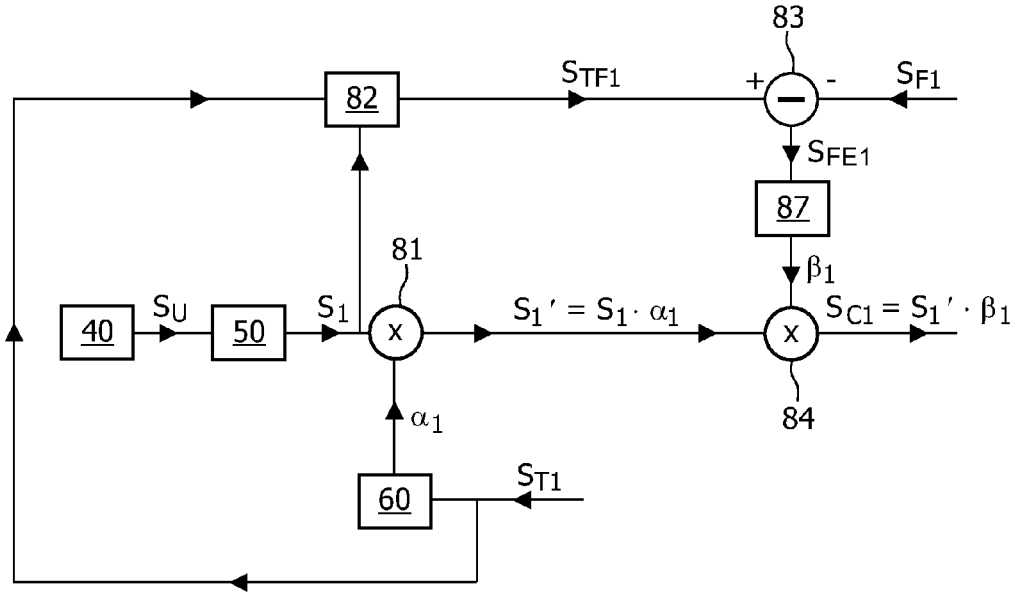
FIGS. 5A and 5B are block diagrams schematically illustrating variations of the operations of FIGS. 3 and 4, respectively.
Figure 5B:
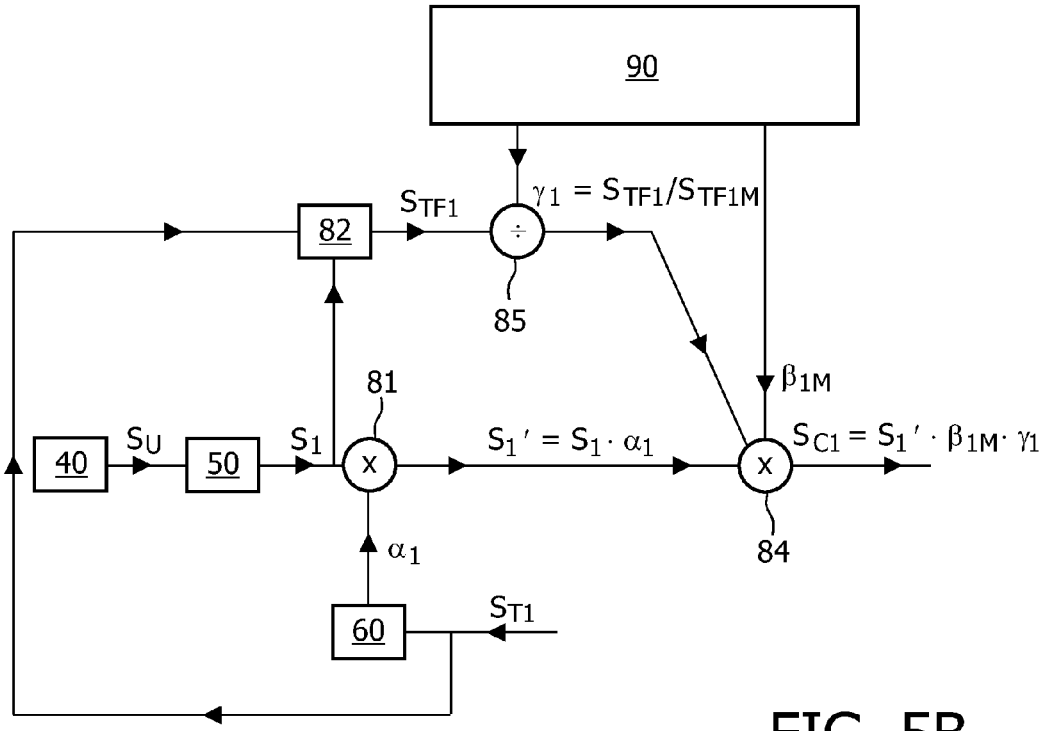

Further, in the above exemplary description, the compensation for color deviations and flux deviations on the basis of temperature are both attributed to temperature correction memory 60. It is, however, also possible that the temperature correction memory 60 only compensates for the color deviations, and that the flux calculator 82 calculates a target value for the flux on the basis of the user input and the measured temperature, in other words that the flux calculator 82 takes care of the compensation for flux deviations on the basis of temperature. Such possibility for the first operational mode is illustrated in FIG. 5A, which compares to FIG. 3. The corresponding block diagram of the second operational mode is illustrated in FIG. 5B, which compares to FIG. 4. At the moment of selecting the second mode of operation, the second correction values $\beta_1$, $\beta_2$, $\beta_3$ are stored in memory 90. Likewise, the corresponding target flux signals $S_{TF1}$, $S_{TF2}$, $S_{TF3}$ are stored in memory 90, indicated as "memorized" target flux signals $S_{TF1M}$, $S_{TF2M}$, $S_{TF3M}$. During operation, the flux calculator 82 calculates a target flux value $S_{TF1}$ on the basis of the momentary temperature. This momentary target flux value $S_{TF1}$ is divided by the "memorized" target flux signal $S_{TF1M}$ (divider 85), to give a third correction value $\gamma 1$. Multiplier 84 multiplies the second approximation value $S_1'$ by this third correction value $\gamma 1$ and by the memorized second correction values $\beta_{1M}$, $\beta_{2M}$, $\beta_{3M}$ read from memory 90. Thus, the control signal $S_{C1}$ is generated on the basis of the "memorized" flux data but flux deviations caused by temperature changes are taken into account.

In the above, the present invention has been explained with reference to block diagrams, which illustrate functional blocks of the device according to the present invention. It is to be understood that one or more of these functional blocks may be implemented in hardware, where the function of such functional block is performed by individual hardware components, but it is also possible that one or more of these functional blocks are implemented in software, so that the function of such functional block is performed by one or more program lines of a computer program or a programmable device such as a microprocessor, microcontroller, digital signal processor, etc.

The invention claimed is:

1. An illumination system, comprising:

(i) a plurality of light sources generating light of mutually different colors, each provided with an associated driver;

(ii) a controller for generating control signals for controlling the respective drivers; temperature feed forward means for establishing a temperature feed forward correction mechanism; and (iii) flux feedback means for establishing a flux feedback correction mechanism;

wherein the controller is capable of operating in a first mode of operation wherein both the temperature feed forward correction mechanism and the flux feedback correction mechanism are active;

wherein the controller is capable of operating in a second mode of operation wherein the temperature feed forward correction mechanism is active and the flux feedback correction mechanism is inactive; and wherein the controller is configured to monitor the duty cycles of the control signals and to select its said first or second mode of operation on the basis of said duty cycles, wherein controller, when operating in the first mode of operation, on finding that at least one duty cycle is less than a predetermined value, is configured to switch over to the second mode of operation; and wherein the controller, when operating in the second mode of operation, on finding that all duty cycles are higher than said predetermined value, is configured-to switch over to the first mode of operation, wherein said flux feedback means comprise calculating means for calculating a flux error signal on the basis of comparing a target flux signal and a measured flux signal with each other, and wherein said flux feedback means comprise compensating means receiving a correction signal derived from said flux error signal and calculating a corrected control signal from an intermediary control signal value.

2. The illumination system according to claim 1, wherein said calculating means comprise a subtractor receiving the target flux signal at a first input and receiving the measured flux signal at a second input.

3. The illumination system according to claim 1, wherein said compensating means comprise a multiplier receiving the correction signal at a first input and receiving an intermediary control signal value at a second input.

4. The illumination system according to claim 1, further comprising temperature sensing means for generating a temperature signal indicating a temperature of the light sources, and wherein said intermediary control signal value is calculated from a user input value by multiplying the user input value by a first correction signal based on said temperature signals.

5. The illumination system according to claim 1, further comprising a flux correction memory; wherein the controller, when operating in the first mode of operation, on finding that at least one duty cycle is less than a predetermined value, is configured to store the current values of the correction signals into said memory; and wherein the controller, when operating in the second mode of operation, is designed to read the memorized correction signals from said memory in order to calculate the corrected control signal from the intermediary control signal value.

* * * * *